United States Patent [19]

Loutan

[11] Patent Number: 4,953,726

[45] Date of Patent: Sep. 4, 1990

[54] ELECTRIC VEHICLE COUPLING BETWEEN TWO RAIL VEHICLES

[75] Inventor: Dominique Loutan, Geneva, Switzerland

[73] Assignee: Asea Brown Boveri Ltd., Baden, Switzerland

[21] Appl. No.: 343,599

[22] Filed: Apr. 27, 1989

[30] Foreign Application Priority Data

Apr. 28, 1988 [CH] Switzerland ..... 1586/88

[51] Int. Cl.[5] ..... B61G 5/06

[52] U.S. Cl. ..... 213/1.3; 439/34; 74/50

[58] Field of Search ..... 213/1.3, 1.6, 75 D, 213/77, 1 R; 280/422; 439/34, 35, 131, 132, 259, 263; 74/570, 50; 191/11

[56] References Cited

U.S. PATENT DOCUMENTS 564,194 7/1896 Hamann ..... 74/50
672,320 4/1901 Ford ..... 74/50
1,422,241 7/1922 Tomlinson ..... 213/1.3
1,608,732 11/1926 Farmer ..... 213/1.3

FOREIGN PATENT DOCUMENTS 2043720 10/1971 Fed. Rep. of Germany ..... 439/132
0398678 3/1966 Switzerland ..... 213/1.3

*Primary Examiner*—Robert P. Olszewski
*Assistant Examiner*—Mark T. Le
*Attorney, Agent, or Firm*—Oblon, Spivak, McClelland, Maier & Neustadt

[57] ABSTRACT

To be able to automatically operate an electric vehicle coupling with a contact bush, there is provided a one way drive which both advances the contact bush (for coupling) and retracts it (for uncoupling) via an eccentrically mounted rolling wheel and a slide rail in which the rolling wheel slides. The rolling wheel has an eccentricity of $(\Delta x+\epsilon)/2$, where $\Delta x$ is a desired advance and $\epsilon$ is a compression advance.

7 Claims, 2 Drawing Sheets

ELECTRIC VEHICLE COUPLING BETWEEN TWO RAIL VEHICLES

BACKGROUND OF THE INVENTION

1. Field of the Invention

The invention relates to an electric vehicle coupling with a contact bush for making an electric connection between two rail vehicles.

2. Description of the Related Art

A mechanical and an electric coupling are necessary to couple two rail vehicles. The mechanical coupling transmits the tractive forces of the traction vehicle to the rest of the cars and the electric coupling makes the electric contact for control and supply purposes.

For greater efficiency for personnel and rolling stock there is a demand for a fully automatic vehicle coupling. For such a fully automatic electric vehicle coupling, it must be possible to advance and retract the contact bush with the electric contacts. In the advanced position, i.e., in the coupled position, the electric contact by the contact bush between the coupled vehicle has to be guaranteed despite small movements, e.g., in spite of the play in the mechanical coupling. The coupling, both mechanical and electric, must also be simple.

SUMMARY OF THE INVENTION

The object of the invention, therefore, is to provide an electric vehicle coupling with a contact bush for making an electric connection between two rail vehicles which operates fully automatically, is simple and compact and, if necessary, can also be operated manually.

This object is achieved according to the invention in that a drive, always turning in the same direction, both advances the contact bush (for coupling) and retracts it (for uncoupling) via an eccentric element.

According to a preferred embodiment, the eccentric element comprises a disk wheel with an eccentrically attached rolling wheel and a slide rail in which the rolling wheel is guided.

Preferably, the contact bush is fastened to the end of a thrust pin, on which the slide rail is axially flexibly mounted, and the slide rail extends perpendicular to the thrust pin. The eccentric is mounted with an eccentricity of $(\Delta x+\epsilon)/2$, where $\Delta x$ indicates a desired advance and $\epsilon$ indicates a compression advance.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
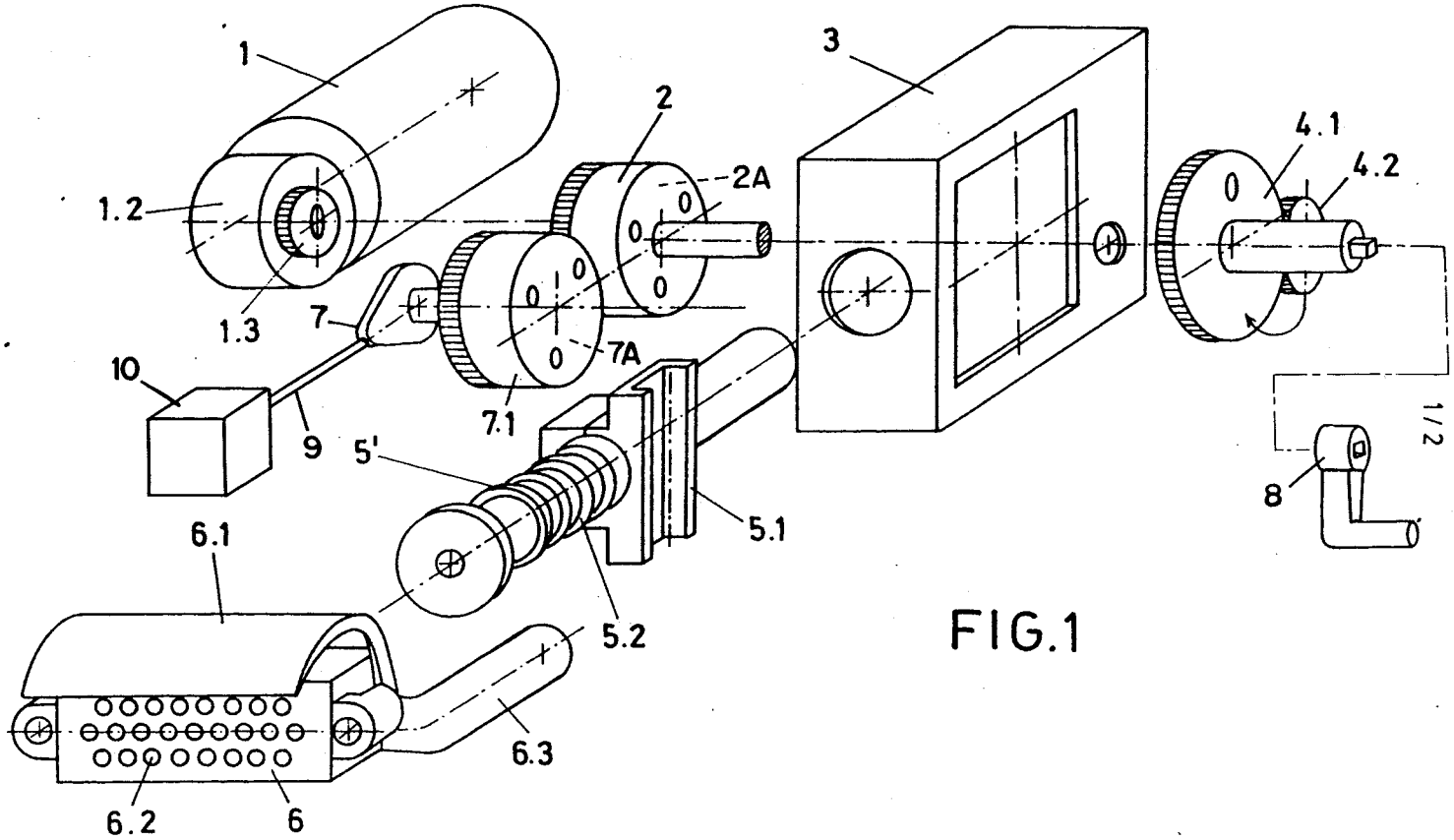
FIG. 1 is an exploded drawing of an electric vehicle coupling according to the invention.

FIG. 1 shows an exploded drawing of a preferred embodiment of the invention.

A drive 1, e.g., a single direction electric motor mounted to a first coupled vehicle, is equipped with a powerful reduction gear 1.2, e.g., a worm gear. On an output of reduction gear 1.2 there is a pinion 1.3, which meshes with a first gear 2 which can be selectively coupled to its shaft. For example, the gear 2 can house a magnetic clutch 2A between the gear teeth and the shaft. The gear 2 is in turn connected by a first shaft with a reducing gear 4.2. Reducing gear 4.2 drives a disk wheel 4.1. The two gears 2 and 4.2 thus form a gear unit.

Disk wheel 4.1 is provided with an eccentrically fastened rolling wheel 4.3 (not shown in FIG. 1), which runs in a slide rail 5.1. Disk wheel 4.1, rolling wheel 4.3 and slide rail 5.1 thus form an eccentric.

Slide rail 5.1 is mounted on a thrust pin 5. Here, slide rail 5.1 extends perpendicular to thrust pin 5 and can slide in the axial direction on the thrust pin. Finally, on a front end of thrust pin 5 there is fastened a contact bush 6, which makes electric contact with the bush of second coupled vehicle.

A spring 5.2, which presses thrust pin 5 forward relative to slide rail 5.1., is placed between contact bush 6 and slide rail 5.1. A collar 5.3 (not shown in FIG. 1) placed on thrust pin 5 provides slide rail 5.1 with a stop toward the rear.

On its front, contact bush 6 has electric contacts 6.2, which are connected by a cable in a cable conduit 6.3 to the corresponding parts in the vehicle. A hinged protective cover 6.1 covers the electric contacts if no electric coupling exists with another vehicle.

A box 3 houses the eccentric and parts of the reducing gear unit, supports the thrust pin 5 and provides journals for the gear shafts. The box 3 is mounted to the first coupled vehicle.

The operating principle of the electric vehicle coupling is explained below by FIGS. 2 to 4. The same parts are provided with the same reference numbers in all the figures.

Figure 2:
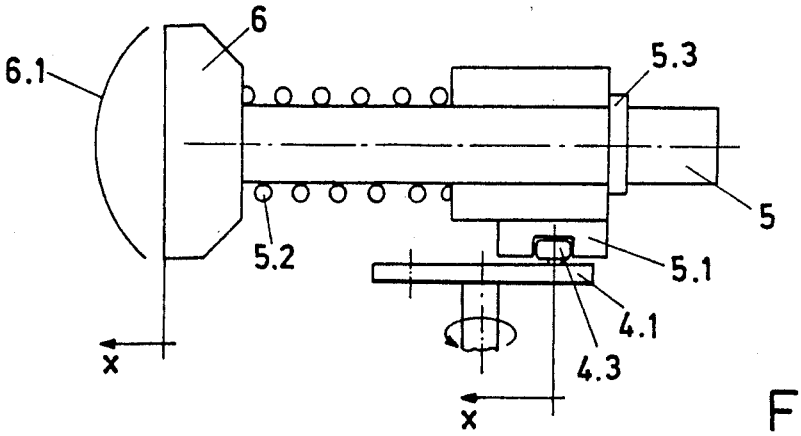
FIG. 2 shows the thrust pin in the retracted position.

FIG. 2 shows the thrust pin 5 in a retracted position. Of the parts already described, the following can be seen in FIGS. 2 to 4: disk wheel 4.1, rolling wheel 4.3 which engages slide rail 5.1, spring 5.2, collar 5.3 placed on thrust pin 5, contact bush 6 and protective cover 6.1.

Disk wheel 4.1 and slide rail 5.1 are positioned such that pin 5 is maximally retracted in its rear dead center position. Protective cover 6.1 is folded down.

For coupling, disk wheel 4.1, is turned by drive 1 and the gear unit, e.g., in the marked direction. Rolling wheel 4.3 and slide rail 5.1 convert the rotation of the disk wheel 4.1 into linear movement in direction x. Thrust pin 5 is then advanced with contact bush 6, and simultaneously protective cover 6.1 is folded away. For this purpose, protective cover 6.1 is mounted on contact bush 6 so as to rotate around an axis perpendicular to the drawing planes (in FIG. 2) and is retained on stationary box 3 by a rod (not shown).

Figure 3:
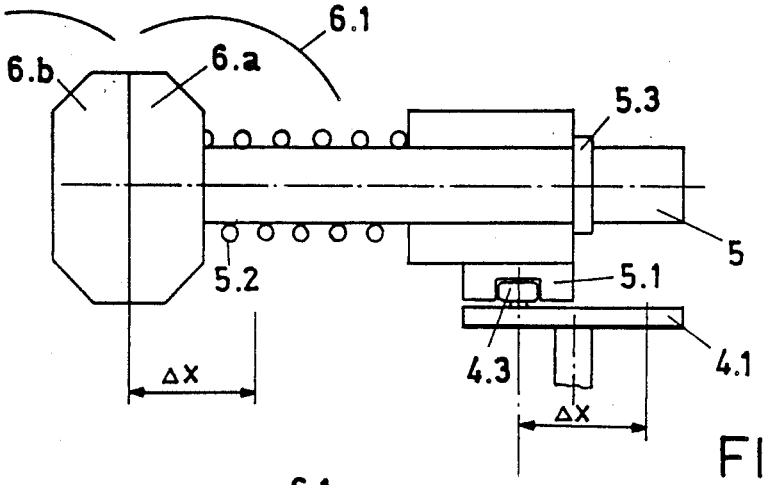
FIG. 3 shows the thrust pin in advanced position before the compression advance.

FIG. 3 shows the thrust pin 5 in an advanced position. Thrust pin 5 and rolling wheel 4.3 have now advanced by a desired advance $\Delta x$ so that contact bush **6*a* is in contact with symmetrically advanced contact bush 6*b* of the second vehicle to be coupled. However, disk wheel 4.1 has not yet turned a full 180° relative to the initial position of FIG. 2**.

Figure 4:
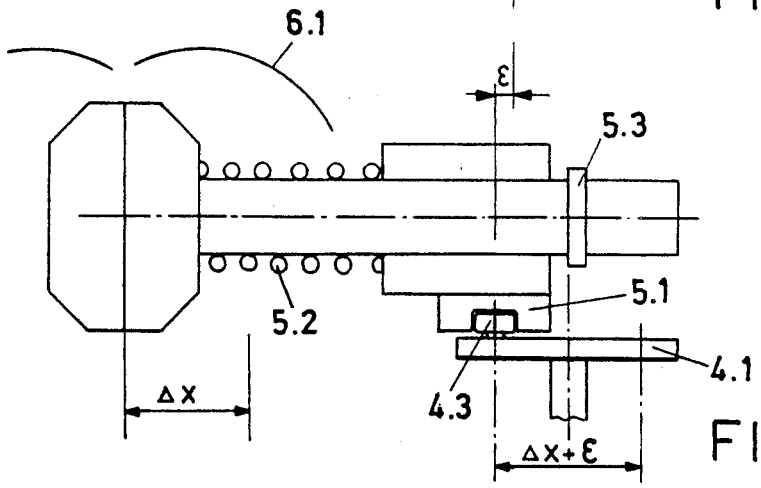
FIG. 4 shows the thrust pin in final position after the compression advance.

Finally, FIG. 4 shows thrust pin 5 when disk wheel 4.1 has turned a full 180° relative to the initial position and thus is in the forward dead center position. Slide rail 5.1 has further advanced on thrust pin 5 by a compression advance $\epsilon$, as a result of which spring 5.2 is loaded. The two contact bushes 6a, 6b of the two coupled vehicles are pressed on one another. The compression advance $\epsilon$ absorbs small movements of the vehicles without permitting uncoupling of bushes 6a and 6b.

If for any reason (e.g., because of failure or a no-load test) contact bush 6b of the second vehicle is not there to offer counterpressure, the thrust pin is advanced a distance of $\Delta x+\epsilon$ and spring 5.2 is not loaded.

For uncoupling, disk wheel 4.1 is further rotated 180° C. by means of drive 1 and the gear unit in the same direction of rotation, so that it again comes into the position shown in FIG. 2. In this case, in reversal of coupling, slide rail 5.1 is retracted a distance $\Delta x+\epsilon$ and thrust pin 5 a distance $\Delta x$.

An advantage of the invention is that the drive can operate cyclically and continuously. Disk wheel 4.1 with one rotation performs both the "coupling" and "uncoupling" functions.

It is also possible to disengage gear 4.2 from gear 2 and thus break the drive between drive 1 and disk wheel 4.1, for example, by uncoupling gear 2 from its shaft. At the same time, a crank can be fastened to a shaft of disk wheel 4.1 to turn it directly by hand via handle 8. In this way it is possible to perform the coupling even if drive 1 is defective.

According to another preferred embodiment, a cam 7, by which a release device 9 of a mechanical coupling 10 between the rail vehicles can be activated, can be coupled to pinion 1.3 (FIG. 1) by means of a couplable second disk wheel 7.1, which may also have a magnetic clutch 7A for coupling to cam 7. For this purpose, gear 2 is uncoupled from its shaft and disk wheel 7.1 is coupled to cam 7. Then cam 7 is rotated once by drive 1. Afterward, gear 2 is again coupled to its shaft and disk wheel 7.1 is uncoupled.

Altogether, the invention provides an electric vehicle coupling, which operates fully automatically, assures a good electric contact even in case of vibrations and is mechanically and electrically simple.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. An electrical vehicle coupling between two rail vehicles, comprising:

an electrical contact bush for each of said vehicles, each of said contact bushes being movable between an advanced position where said contact bushes are mutually coupled and provide electrical connection between said two rail vehicles and a retracted position where said contact bushes are mutually uncoupled;

drive means for moving each of said bushes between said advanced position and said retracted position, each of said drive means including:

an eccentric element mounted to a rotatable disk wheel at a position eccentric to the axis of rotation of said disk wheel;

means for rotating said disk wheel in one direction;

a slide rail associated with a respective said bush, wherein said eccentric element moves in a slide of said slide rail, whereby said bush moves from said retracted position to said advanced position and back to said retracted position for each revolution of said disk wheel;

thrust pins on which said bushes are respectively mounted, said slide rails being respectively slidably mounted to said thrust pins for movement in the direction of the axis of said thrust pins, wherein each said slide extends perpendicular to a respective one of said thrust pins.

2. The coupling of claim 1 including spring means for elastically coupling each said bush to a respective said slide rail in the axial direction of said thrust pin.

3. The coupling of claim 2, wherein each said eccentric element has an eccentricity of:

$$(\Delta x+\epsilon)/2$$

where:

$\Delta x$ is a distance in the axial direction of each said thrust pin between said retracted position and said advanced position, and $\epsilon$ is a coupling compression advance of each said slide rail.

4. The coupling of claim 3, wherein said means for rotating each said disk wheel in one direction comprises a single directional motor and speed reducing gear means connected between said motor and said disk wheel.

5. The coupling of claim 4, including means for selectively disengaging each said speed reducing gear means from a respective said disk wheel, whereby said disk wheel may be manually rotated.

6. The coupling of claim 4, including means for releasing a mechanical coupling between said rail vehicles, comprising a cam mounted on a second disk wheel meshing with each said speed reducing gear means, and means for releasably coupling each said second disk wheel to a respective said cam.

7. The coupling of claim 4, wherein each said speed reducing gear means comprises:

a first gear driven by a respective said motor and having means for selective coupling to a shaft thereof, and a reducing gear mounted to said shaft and meshing with said disk wheel.

* * * * *